United States Patent [19]

Ames

[11] 4,407,537

[45] Oct. 4, 1983

[54] DOOR AND LOCK SUPPORT

[76] Inventor: Earl J. Ames, P.O. Box 7496, Toledo, Ohio 43615

[21] Appl. No.: 313,164

[22] Filed: Oct. 20, 1981

[51] Int. Cl.[3] ..... E05B 9/08; E04C 2/52

[52] U.S. Cl. ..... 292/337; 49/503; 52/787

[58] Field of Search ..... 292/1, 337; 49/501, 49/503; 248/57, 56; 52/707, 787

[56] References Cited

U.S. PATENT DOCUMENTS

| | | | |
|---|---|---|---|
| 1,787,446 | 1/1931 | Harbert | 248/56 |
| 1,876,079 | 9/1932 | Schlage | 292/337 X |
| 1,981,289 | 11/1934 | Schlage | 292/337 |
| 3,918,667 | 11/1975 | Madden | 248/56 |
| 4,118,895 | 10/1978 | Governale | 49/503 |
| 4,218,848 | 8/1980 | Nelson | 49/503 |

FOREIGN PATENT DOCUMENTS

| | | | |
|---|---|---|---|
| 2323255 | 1/1977 | France | 248/56 |

*Primary Examiner*—Thomas J. Holko
*Assistant Examiner*—R. Illich
*Attorney, Agent, or Firm*—Wilson, Fraser, Barker & Clemens

[57] ABSTRACT

A reinforcing device for use in hollow doors and in conjunction with a lockset. The device includes ribs for spanning the space between opposing inner surfaces of the hollow door for maintaining a predetermined spacing therebetween. Further, the device includes at least a portion for surrounding a retracting mechanism of the lockset and a portion tending to support a retractible bolt.

5 Claims, 7 Drawing Figures

DOOR AND LOCK SUPPORT

BACKGROUND OF THE INVENTION

1. Field of the Invention

This invention generally relates to hollow doors and, more particularly, to internally disposed reinforcing devices for supporting cylindrical locksets therein.

2. Description of the Prior Art

Currently many of the types of cylindrical lock sets used in hollow doors include separate retractible bolt units and retracting lock case units. Conventionally, the latch unit includes a cylindrical housing having engaging tabs at its inner end and a retractible bolt mechanism. The lock case unit includes a stationary case having portions slidable into engagement with tabs provided on the latch unit for attaching the two members together. Further, the lock case unit includes a retracting mechanism having a portion slidable into engagement with a tab extending from the ends of the retractible bolt for attaching the bolt to the retracting mechanism.

Frequently, the two above described engaged units become disengaged during use as flexing of the spaced panels of the door causes the lock case unit to loosen with respect to the panels. Then, the lock case unit is able to move relative to the bolt unit. As the door panels are flexed over a period of use, the movement of the lock case unit relative to the bolt unit becomes larger and larger until the slidable portion of the lock case unit moves out of engagement with the tabs of the latch unit. This problem is particularly pronounced in respect to hollow doors constructed of metal.

SUMMARY OF THE INVENTION

The present invention overcomes the aforementioned problem by providing a reinforcing device interiorly of the hollow door adjacent the lock case unit, which maintains a predetermined spacing between the opposed inner surfaces of the hollow door. This structural arrangement permits the inner and outer roses of the cylindrical lockset to snugly clamp the inner and outer panels of the hollow door to each other so that pushing and pulling of the knobs of the lock set will not flex either of the panels thus loosening the lock case unit containing the retracting mechanism.

Preferably, the reinforcing device of the invention is in the form of an elongate flexible member formed of plastic material having memory. The flexible member includes a number of spaced apart rib portions extending transversely of the member and adapted to span the space between the opposing inner surfaces of an associated hollow door. The rib portions of the device are interconnected by panel sections including hinges of reduced cross-section. Aperture means are provided for allowing the latch unit of the lockset to extend therethrough. Each end of the elongate member of the device is provided with cooperating locking means which detachably connect the ends together for forming the member into an annular configuration adapted to surround the lock case unit containing the retracting mechanism of the lockset.

An object of the invention is to produce a reinforcing device for hollow doors which maintains a predetermined spacing between the opposing inner surfaces of the doors.

Another object of the invention is to produce a reinforcing device which is simple in construction, easy to use and inexpensive to manufacture.

Another object of the invention is to produce a reinforcing device which will inherently aid in maintaining the associated locking mechanisms free from particulate contaminants which otherwise would adversely affect the locking mechanisms operation.

Still another object of the invention is to produce a reinforcing device which can be applied to existing hollow doors without the requirement of special tools or expertise.

BRIEF DESCRIPTION OF THE DRAWINGS

The above as well as other objects of the invention will become readily apparent to one skilled in the art from the reading of the following detailed description of a preferred embodiment of the invention when considered in the light of the accompanying drawings in which.

DESCRIPTION OF THE PREFERRED EMBODIMENT

Figure 1A:
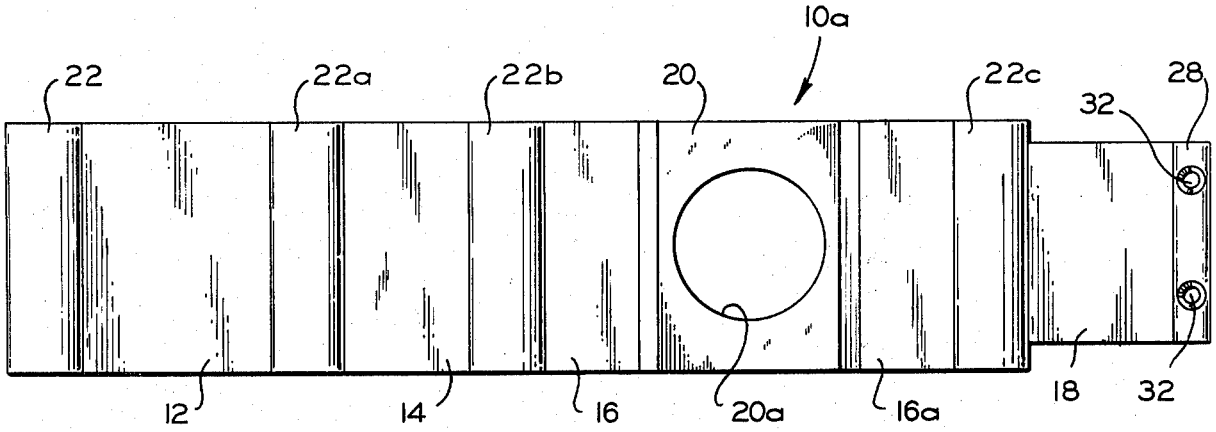
FIGS. 1A, 1B and 1C are top, cross-sectional and bottom views respectively, of a reinforcing device constructed in accordance with the invention.
Figure 1B:
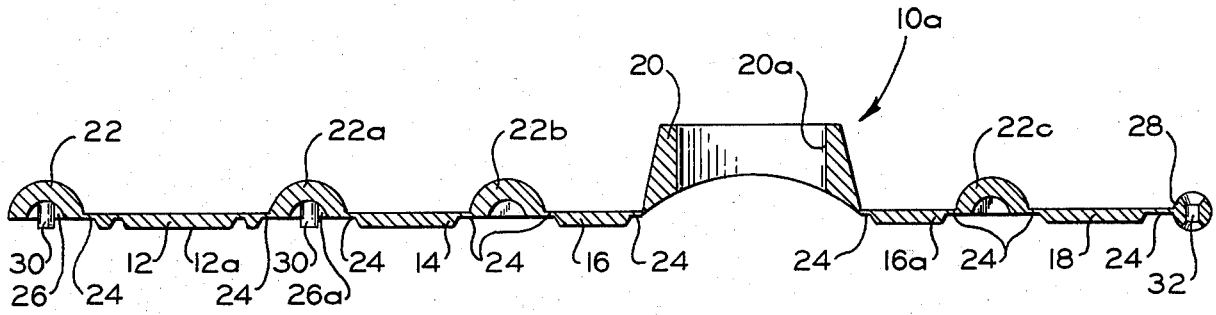
Figure 1C:
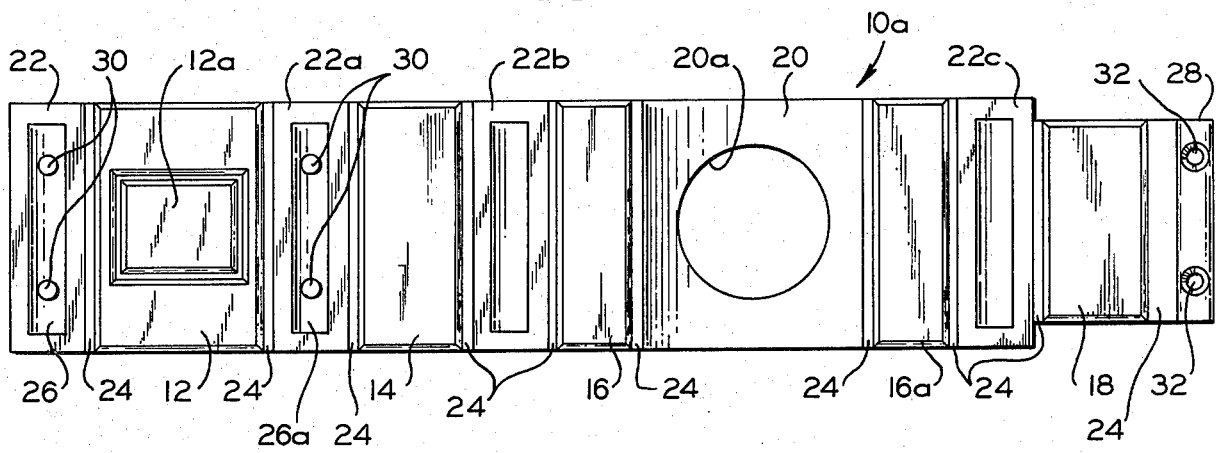
Figure 3:
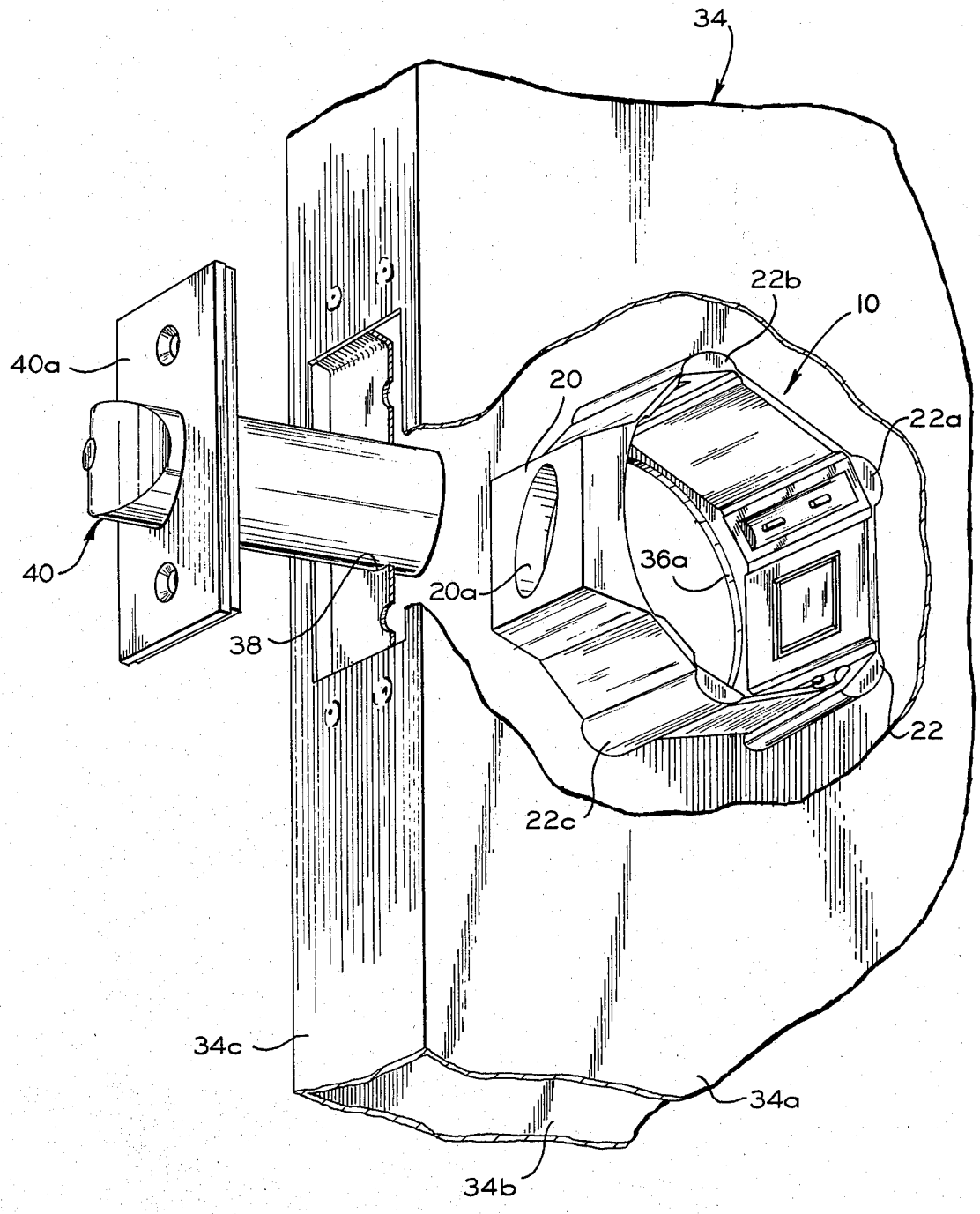
FIG. 3 is a fragmentary perspective view with portions broken away, illustrating the position of a reinforcing device in the interior of the door together with a latch unit prior to assembly.
Figure 4:
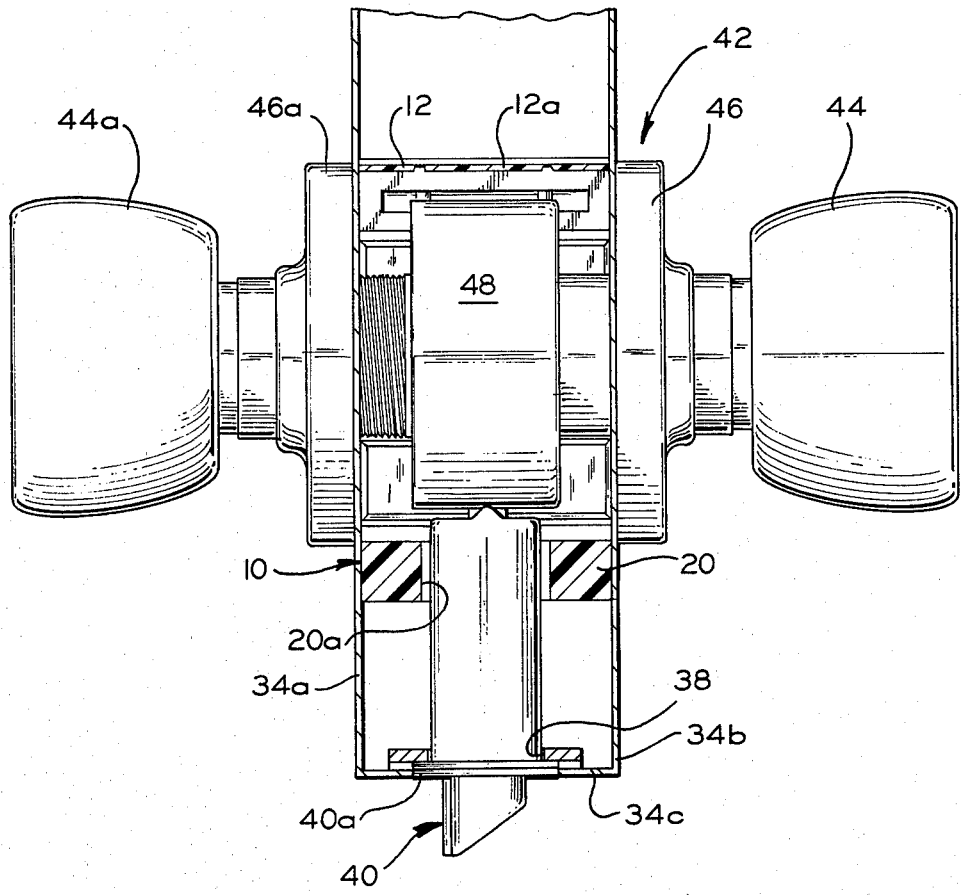
FIG. 4 is a partly cross-sectional view through a hollow door illustrating the reinforcing device assembled with a cylindrical lockset.

Referring to the drawings wherein like reference numerals designate similar parts throughout, there is illustrated in FIGS. 3 and 4 an annular reinforcing device 10 constructed in accordance with the invention. As illustrated in FIGS. 1A through 1C, the reinforcing device 10 is formed from an elongate substantially flat flexible member **10*a* preferably molded in one piece of a high compression-resistance plastic material such as polypropylene which has memory, that is, it tends to return to its original posture. The elongate member 10*a* generally includes a number of panel portions 12, 14, 6, 16*a* and 18 and a boss 20 disposed between the panel sections 16 and 16*a*. The boss 20 is provided with an aperture 20*a* for receiving a retractible lock bolt of a lockset. The elongate member 10*a* also includes a number of similar, transversely extending, reinforcing ribs 22, 22*a*, 22*b* and 22*c* which are integrally interconnected by molded portions 24 (see FIG. 1B) of reduced cross-section, to the panel portions 12, 14, 16*b* and 18 respectively. The molded portions 24 function as hinges for permitting the panel sections to form an annular configuration, the purpose of which will be described hereinafter. The boss 20 is also interconnected to the panel portion 16 and 16*a* by similar molded portions 24** also functioning as hinges.

As is known, cylindrical locksets generally are produced in two sizes which require corresponding size cross bore holes. Accordingly, one end of the elongate flexible member 10*a* is provided with means for accommodating two sizes of cross bore holes. Referring now to FIG. 1B, it should be noted that at least the bottom surfaces of the ribs 22 and 22*a* are provided with concave portions which serve as sockets 26 and 26*a* respectively, for receiving an elongate cylindrical tab 28 integrally attached to the other end of the elongate member 10*a*, that is to the panel portion 18 by a hinge portion 24. Each socket 26 and 26*a* may be provided with a pair of depending pins 30 which snugly engage the walls defining apertures 32 provided in the tab 28 for detachably attaching the ends of the elongate flexible member 10*a* together for forming the member 10*a* into the annular configuration of the reinforcing device 10 in either of two sizes. A knock-out section 12*a* may be provided in the panel 12 for accommodating long retractible bolts of other types of locksets.

Figure 2:
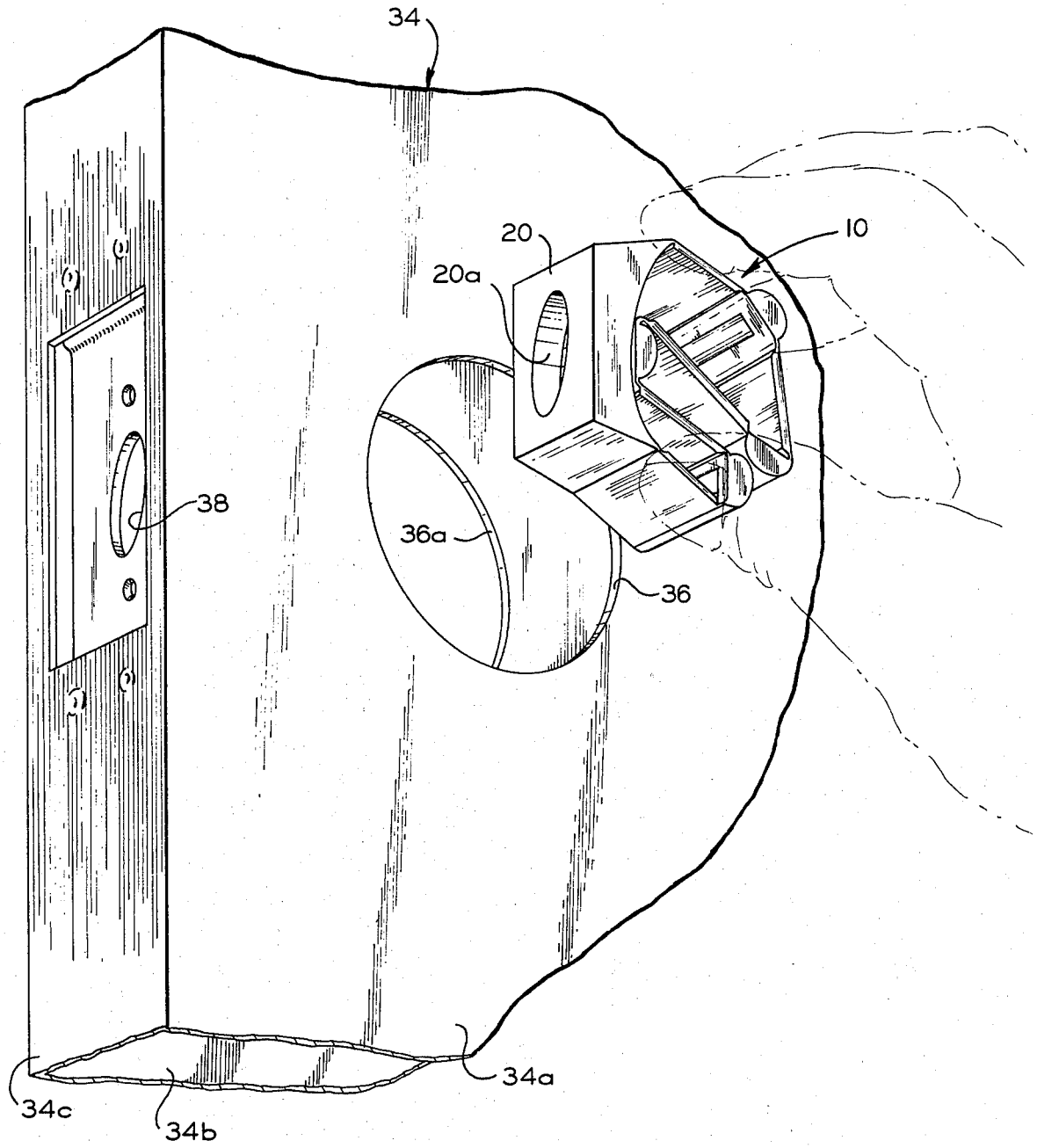
FIG. 2 is a fragmentary perspective view illustrating a folded reinforcing device just prior to being inserted through a cross hole in one of the panels and into the interior of a hollow door.

Conventionally, a hollow door 34 includes side panels 34*a* and 34*b* and a frontal edge 34*c*. In use, the reinforcing device 10 is folded, as illustrated in FIG. 2, and inserted in one of the cross bore holes 36 and 36*a* provided in the side panels 34*a* and 34*b* respectively, of the hollow door 34. The hole 20*a* of the boss 20 is aligned with a hole 38 provided in the edge 34*c* of the door 34. The length of the transversely extending ribs 22, 22*a*, 22*b* and 22*c* as well as the corresponding width of the boss 20 spans the space between opposing inner surfaces of the door panels 34*a* and 34*b*. In this manner, the reinforcing device 10 may be frictionally held in place when it is disposed within the interior of the door 34.

As illustrated in FIG. 3, a latch bolt unit 40 of a knob type lockset 42 (see FIG. 4) passing through the edge hole 38 will also pass through the aligned hole 20*a* in the reinforcing device 10 until the face plate 40*a* of the latch bolt unit 40 is flush with the surface of the edge 34*c* of the door 34 (see FIG. 4).

Referring specifically to FIG. 4, the knob lockset 42 conventionally includes inner and outer knobs 44 and 44*a* respectively, inner and outer rose assemblies 46 and 46*a* respectively, and a lock case unit 48 containing the latch bolt retracting mechanism (not shown) which is operated by the knobs 44 and 44*a*.

Figure 5:
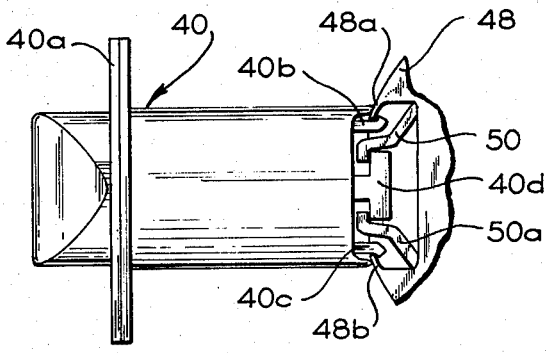
FIG. 5 is an enlarged side elevational view of the latch unit illustrating the engagement of the lock case unit with the latch unit.

In assembling the lockset 42 within a hollow door, the space between the inner and outer rose assemblies 46 and 46*a* respectively, is set to align and engage the lock case unit 48 with the latch bolt unit 40 as illustrated in FIG. 5. Initially, when properly set, the lock set 42 is securely fastened to the door 34.

When a lockset 42 is conventionally set in a hollow door, particularly when the hollow door is made of metal, the door panels 34*a* and 34*b* flex while pushing and pulling on the knobs 44 and 44*a*. After a period of flexing, the door panels 34*a* and 34*b* becomes distorted thus causing the rose assemblies 46 and 46*a* to loosen with respect to the door panels. Accordingly, the knobs and rose assemblies become loose, wobbly and move relative to the door. Thus, the lock case unit 48 will also move with respect to the latch bolt unit 40. Upon large degrees of movement, the lock case engaging tabs 48*a* and 48*b* (see FIG. 5) will become disengaged from the locking tabs 40*b* and 40*c* respectively of the latch bolt unit 40. Also the tabs 50 and 50*a* of the retracting mechanism will be disengaged from the T-tab 40*d* extending from the retractible bolt of the latch bolt unit 40 rendering the lockset 42 inoperable.

However, when the lockset is installed with the reinforcing device 10 of the invention, the aforedescribed flexing of the door panels and consequent loosening of the lockset does not occur. In other words, the reinforcing device 10 spanning the space between the opposing inner surfaces of the door panels 34*a* and 34*b* prevents flexing of the panels and consequent loosening and wobbling of the lock case unit 48. Accordingly, the lock case unit 48, containing the retracting mechanism, can not move out of engagement with the retractable latch bolt unit 40. Secondarily, the boss 20 of the reinforcing device 10 tends to eliminate any bolt wobble and loose or broken face plate screws. Furthermore, the outer surface of the reinforcing device 10 will serve as a dust cover for maintaining a clean and free working lockset.

In accordance with the provisions of the patent statutes, the principle and mode of operation of the invention has been explained and what is considered to represent its preferred embodiment has been illustrated and described. It should, however, be understood that the invention may be practiced otherwise than as specifically illustrated and described without departing from its spirit and scope.

What is claimed is:

1. An annular reinforcing device for insertion interiorally into a hollow door for surrounding an internally disposed retracting mechanism and receiving a retractable bolt associated with the retracting mechanism, comprising:

(a) an elongate, substantially flat flexible member;

(b) said elongate, substantially flat flexible member including a number of spaced reinforcing rib portions extending transversely of said elongate, substantially flat flexible member;

(c) a panel section disposed between adjacent rib portions, one of said panel sections having an aperture for receiving the retractable bolt;

(d) hinge means interconnecting the adjacent edges of said rib portions and said panel sections; and (e) detachable interconnecting means affixed to the opposed ends of said elongate, substantially flat flexible member for forming said flexible member into an annular configuration whereby said annular reinforcing device may be folded into a compressed shape and inserted into the interior of the hollow door.

2. The invention defined in claim 1 wherein said detachable interconnecting means includes depending means hingedly connected to one end of said elongate member and socket means hingedly connected to the other end of said elongate member whereby said depending means cooperates with such socket means for holding said elongate flexible member in an annular configuration.

3. The invention defined in claim 1 wherein said elongate flexible member is molded from a plastic material having memory and said hinge means comprises reduced portions between said panel sections.

4. The invention defined in claim 1 wherein said panel section having an aperture extending therethrough includes a boss surrounding the aperture.

5. The reinforcing device, for hollow doors, comprising:

(a) an elongate flexible member;

(b) said elongate member including a plurality of interconnected panel sections;

(c) hinge means interconnecting said panel section;

(d) means attached to each end of said elongate flexible member for detachably interconnecting said ends together whereby said flexible member may be formed into an annular configuration;

(e) a boss having an aperture extending therethrough and interposed between two of said panel sections and hinge means interconnecting said boss to said panel sections; and (f) one of said panel sections including a knock-out portion which is alignable with the aperture in said boss.

* * * * *